US009038388B2

(12) United States Patent
Almbauer

(10) Patent No.: US 9,038,388 B2
(45) Date of Patent: May 26, 2015

(54) METHOD OF OPERATING A PISTON EXPANDER OF A STEAM ENGINE

(75) Inventor: Raimund Almbauer, Graz (AT)

(73) Assignee: MAN TRUCK & BUS OSTERREICH AG, Steyr (AT)

( * ) Notice: Subject to any disclaimer, the term of this patent is extended or adjusted under 35 U.S.C. 154(b) by 294 days.

(21) Appl. No.: 13/020,594

(22) Filed: Feb. 3, 2011

(65) Prior Publication Data

US 2011/0192162 A1 Aug. 11, 2011

(30) Foreign Application Priority Data

Feb. 5, 2010 (AT) ..... A 160/2010

(51) Int. Cl.

| | |
|---|---|
| ***F01K 13/00*** | (2006.01) |
| ***F02G 3/00*** | (2006.01) |
| ***B60K 6/20*** | (2007.10) |
| ***F01K 7/00*** | (2006.01) |
| ***F01B 17/04*** | (2006.01) |
| ***F01K 23/06*** | (2006.01) |

(52) U.S. Cl.
CPC . *F01K 7/00* (2013.01); *F01B 17/04* (2013.01); *F01K 23/065* (2013.01)

(58) Field of Classification Search
USPC ..... 60/516–526, 614–620
See application file for complete search history.

(56) References Cited

U.S. PATENT DOCUMENTS

| | | | | |
|---|---|---|---|---|
| 3,708,979 | A * | 1/1973 | Bush et al. | 60/522 |
| 3,994,640 | A * | 11/1976 | Cohen | 418/68 |
| 4,159,700 | A * | 7/1979 | McCrum | 123/58.8 |
| 4,183,219 | A * | 1/1980 | Vargas | 60/682 |
| 4,327,550 | A * | 5/1982 | Knoos | 60/522 |
| 5,016,441 | A * | 5/1991 | Pinto | 60/516 |
| 5,191,766 | A * | 3/1993 | Vines | 60/619 |
| 5,309,713 | A * | 5/1994 | Vassallo | 60/370 |
| 7,603,858 | B2 * | 10/2009 | Bennett | 60/517 |
| 7,975,485 | B2 * | 7/2011 | Zhao et al. | 60/712 |
| 8,109,097 | B2 * | 2/2012 | Harmon et al. | 60/670 |
| 2003/0196641 | A1 * | 10/2003 | Ashida et al. | 123/432 |
| 2008/0006040 | A1 * | 1/2008 | Peterson et al. | 62/116 |
| 2008/0276615 | A1 * | 11/2008 | Bennett | 60/614 |
| 2009/0107139 | A1 * | 4/2009 | Berger | 60/525 |
| 2009/0241540 | A1 * | 10/2009 | Robel | 60/597 |
| 2009/0301086 | A1 * | 12/2009 | Ralston | 60/620 |
| 2010/0205959 | A1 * | 8/2010 | Kasuya et al. | 60/618 |
| 2011/0023483 | A1 * | 2/2011 | Berger et al. | 60/618 |
| 2011/0192162 | A1 * | 8/2011 | Almbauer | 60/614 |

FOREIGN PATENT DOCUMENTS

| | | | |
|---|---|---|---|
| WO | WO 2009051139 | A1 * | 4/2009 |
| WO | WO 2009080154 | A2 * | 7/2009 |
| WO | WO 2009080154 | A2 * | 10/2009 |

* cited by examiner

*Primary Examiner* — Thomas Denion
*Assistant Examiner* — Mickey France
(74) *Attorney, Agent, or Firm* — Jennifer S. Stachniak; Robert W. Becker

(57) ABSTRACT

A method of operating a piston expander, including introducing live steam into a cylinder space via an inlet valve; expanding the live steam during a power stroke in which a piston moves from an upper dead center position to a lower dead center position; opening an outlet opening as soon as the piston is in the region of the lower dead center position; after the piston reaches the lower dead center position, conveying the expanded steam out of the outlet opening and into a steam discharge; and subsequently closing the outlet opening before the piston in an exhaust stroke reaches the lower dead center position.

9 Claims, 3 Drawing Sheets

METHOD OF OPERATING A PISTON EXPANDER OF A STEAM ENGINE

The instant application should be granted the priority date of 5 Feb. 2010, the filing date of the corresponding Austrian patent application A 160/2010.

BACKGROUND OF THE INVENTION

The present invention relates to a method of operating a piston expander.

To be able to realize a reduction in fuel, especially with mobile internal combustion engines, such as of vehicles, presently mainly two technical solutions are prioritized. In addition to the use of different hybrid concepts, which primarily present an opportunity for city and feeder traffic due to the braking and acceleration processes that occur in such situations, furthermore known are heat recovery systems that utilize the waste heat of an internal combustion engine in order to make additional drive energy available. Such systems for the utilization of waste heat present an opportunity for mobile internal combustion engines, especially for vehicles, that operate in long-distance traffic.

In such waste heat utilization systems, the waste heat available in the area of the internal combustion engine and/or of the exhaust gas discharge is at least partially transferred to a secondary heat circuit in which a heat-carrier fluid is circulated, and generally is at least partially vaporized in an evaporator, the vapor is expanded in an expansion unit, for example in a piston expander, and finally is again liquefied in a condenser. The mechanical work generated with the expansion unit is conveyed as additional work or energy to the drive system, in particular to a vehicle drive system. It is just as conceivable to utilize the mechanical work recovered by the waste heat utilization for driving other components, such as a fan or a compressor, or to generate electrical energy.

In this connection, a heat recovery system for an internal combustion engine is known from DE 10 2006 043 1.39 A1. With the aid of the described system, additional drive energy from the waste heat of the internal combustion engine and/or of the exhaust gas mechanism is made available to the vehicle. After expansion of the vaporous working medium in the expander, the working medium of the secondary heat circuit is conveyed into a condenser, in which the medium is liquefied accompanied by the release of heat, so that the corresponding steam circuit process is closed.

A piston of a lifting piston expansion engine is furthermore known from the currently not yet published European patent application 09009456.6, according to which an outer diameter of the piston neck is less than an outer diameter of the piston head and/or of the piston body, and at the same time the length of the piston neck corresponds approximately to the stroke of the piston. With the described technical solution, it is possible, with the aid of relatively simple structural means, to realize an effective utilization contained in the steam, and thus of the heat due to energy losses available in an internal combustion engine. The described construction of the piston ensures a gentle start of a piston expansion engine and an effective separation of the oil and steam circuits. The effective separation of the oil and steam circuits reliably prevents a reciprocal contamination of the circuits due to transfer of the respective medium.

The steam-piston expanders known in the state of the art generally operate in a two cycle process. In this connection, at the upper dead center position the live steam is introduced into a cylinder of the expander unit via an inlet valve, and in the following power stroke the steam is expanded accompanied by the release of energy. Finally, in the lower dead center position, the outlet valve is opened, and during the exhaust or expelling stroke the expanded steam is expelled out of the cylinder due to the movement of the piston from the lower dead center position to the upper dead center position. When the upper dead center position is reached, the outlet valve is closed and the corresponding cyclical process begins anew. As a function of the live steam parameters, as well as of the counter pressure on the outlet side, the compression rate must be designed such that the working medium is expanded in the power stroke to a suitable level.

If the compression rate is too low, the working medium, when the outlet valve is opened, has an overpressure relative to the counter pressure in the outlet line which, due to the potential possibility of reaching a greater expansion, has a negative effect upon the degree of efficiency of the cyclical process. If, on the other hand, the compression rate is too great, the working medium is expanded to a pressure below the counter pressure in the outlet line, which makes the expelling of the expanded steam more difficult and again has a negative impact upon the degree of efficiency of the cyclical process.

The use of steam-piston expanders during the utilization of waste heat from internal combustion engines requires a complex construction. In order to be able to fulfill all of the requirements with respect to weight, cost, durability and required service, generally stationary valves are used. As a consequence of this measure, there results in the upper dead center position a damage space that is relatively large and thus leads to low geometrical compression conditions. As a result, there is also the problem that not even the damage space can be adequately filled with high steam.

Proceeding from the state of the art and the problems that has been described, it is an object of the present invention to provide a method for the operation of a steam-piston expander unit that can be operated with a relatively high degree of efficiency. The method of the present application is intended in particular to reduce the quantity of live steam required for filling the piston without hereby significantly reducing the degree of efficiency of the cyclical process.

BRIEF DESCRIPTION OF THE DRAWINGS

This object, and other objects and advantages of the present invention, will be described in greater detail subsequently with the aid of the accompanying drawings, which are in no way meant to limit the overall inventive concept and in which.

SUMMARY OF THE INVENTION

Figure 1:
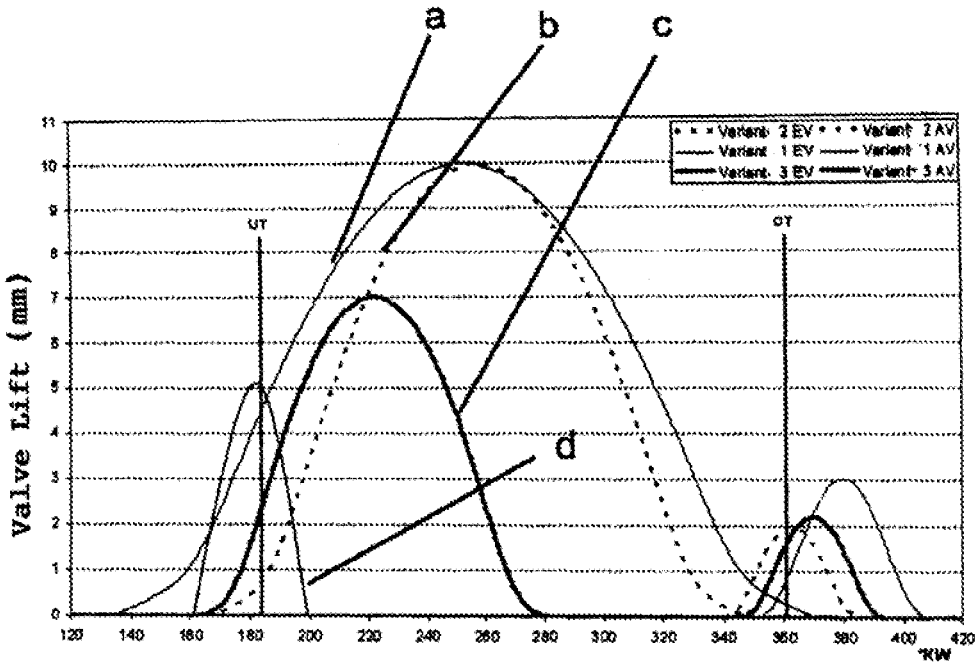
FIG. 1 shows a valve lift graph at the exhaust openings.

The aforementioned object is inventively realized by a method of operating a piston expander, and includes the steps of introducing live steam from a steam feed into a cylinder space via an inlet valve; expanding the live steam, introduced into the cylinder space, during a power stroke in which a piston moves from an upper dead center position to a lower dead center position; opening an outlet opening as soon as the piston is disposed in the region of the lower dead center position; conveying the expanded steam, after the piston reaches the lower dead center position, out of said outlet opening and into a steam discharge; and subsequently closing said outlet opening, before the piston, in an exhaust stroke, reaches the upper dead center position. In this connection, it is in principle conceivable to open the outlet opening only during a relatively short period of time, for example in the lower dead center position, or over a longer time span, primarily until approximately a crankshaft angle of about 30° prior to when the upper dead center position is reached.

In principle, the reduction of the quantity of live steam per cycle of the operating process is possible in two ways. On the one hand, it is conceivable to open the inlet valve for only so long and to such an extent that in the cylinder the live steam pressure is not achieved. In this case, the inlet valve throttles the live steam to a lower pressure than the live steam pressure. However, this reduction of the pressure leads to a significant reduction of the degree of efficiency. For this reason, the inventive method makes use of a second possibility for the reduction of the quantity of live steam per cycle. Here, the outlet opening is not opened during the entire expelling or exhaust stroke, in other words, during the time in which the piston moves from the lower dead center position to the upper dead center position, but rather the outlet opening is closed well before the piston reaches the upper dead center position. With this measure, a considerable quantity of already expanded steam remains in the cylinder and is not conveyed away into the steam discharge.

This residual steam that remains in the cylinder is advantageously compressed in the exhaust stroke by the movement of the piston to the upper dead center position. As a result, when the inlet valve is opened a considerably higher pressure is already present than in comparison to the otherwise existing counter pressure in the cylinder without compression of the residual steam. Due to the pressure within the cylinder that is increased relative to the conventional counter pressure, likewise only a relatively small quantity of live steam is introduced into the cylinder. Nonetheless, due to the introduction of the live steam, the steam mixture formed in the damage volume of the cylinder is brought to a pressure that corresponds to the pressure of the live steam. In this connection, the live steam pressure is achieved by a further compression of the already compressed residual steam within the damage volume of the cylinder, whereby the state of the steam mixture after introduction of the live steam is established as a function of the states of the pre-expanded residual steam and of the live steam. This mixed steam pressure can be achieved independently of the selection of a suitable compression condition.

As a consequence of the inventive method for operating a piston expander, there is advantageously achieved that the degree of efficiency of the expander is relatively high, and at the same time a moderate increase of pressure within the cylinder is achieved. The moderate increase in pressure is based on the fact that this increase is realized over a longer time span, since first the residual steam is pre-expanded, and only subsequently thereto is it compressed to the live steam pressure level by the introduction of live steam.

As already mentioned, two alternative embodiments of the inventive method are conceivable. Pursuant to a first embodiment, the outlet opening is closed as soon as the piston is disposed in a region between the lower and upper dead center positions. Preferably, the outlet opening is closed at a crankshaft angle of 20° to 60° prior to the upper dead center position. Particularly suitable is the closing of the outlet opening in a region of about 45° crankshaft angle prior to the upper dead center position.

The second alternative embodiment quasi represents a limiting case for the inventive method. With this variant, the outlet opening is exclusively opened and held open as soon as and as long as the piston is disposed in the region of the lower dead center position. With such an embodiment of the inventive method, it is furthermore preferably conceivable to provide openings, especially slots, in the region of the cylinder wall; these openings or slots are released when the piston edge passes over during the expansion stroke, and are again closed when the piston edge passes over during the exhaust stroke. In this manner, the outlet opening is released for the discharge of the at least partially expanded steam as soon as the piston is disposed in the vicinity of the lower dead center position. Pursuant to a preferred embodiment, the opening is effected in a crankshaft angle range of from 20° prior until 20° after the lower dead center position. A particularly special further development of the invention, at a piston stroke of from 75 to 85 mm, and in particular 80 mm, provides a crankshaft angle range of 30° for opening of the outlet valve. If subsequent to the opening of the outlet valves the piston again moves in the direction of the upper dead center position, the outlet opening or openings are again closed. With such an embodiment, the inventive method can be realized with relatively straightforward means. In particular, the use of an additional outlet valve can be eliminated. The opening of the outlet valve is effected, with the previously described embodiment of the inventive method, in the lower dead center position. If the piston moves from the lower dead center position in the direction toward the upper dead center position, the outlet opening is again closed, so that the steam mixture remaining in the cylinder is compressed.

The inlet or intake valve is preferably opened as soon as the piston reaches the upper dead center position, and is kept open until a crankshaft angle of about 30° after the upper dead center position. The great advantage of the inventive method is based upon the mixing of two steams in the damage volume, namely the live steam as well as the pre-compressed residual steam, which exergetically are comparatively similar.

When carrying out the inventive method, there is furthermore preferably ensured that in a time frame between the closing of the outlet opening and the subsequent closing of the inlet valve, a steam mixture is produced by the supply of the live steam into the cylinder space, in particular the damage volume of the cylinder space; the pressure of this steam mixture corresponds at least approximately to the pressure of the live steam. The relatively high mixed steam pressure is in this connection achieved by a further compression of the already pre-compressed residual steam within the damage volume of the cylinder, whereby the state of the steam mixture after the introduction of the live steam is established as a function of the states of the pre-compressed residual steam and of the live steam. By mixing the live steam with the pre-compressed residual steam, a steam mixture is produced that has an enthalpy that is increased relative to conventional conditions. This measure increases the degree of efficiency of the cyclical process in a relatively straightforward manner.

Further specific features of the present application will be described in detail subsequently.

DESCRIPTION OF SPECIFIC EMBODIMENTS

Referring now to the drawings in detail, FIG. 1 illustrates the lift of a valve in an outlet opening of the cylinder of a steam expander. Shown are the operating curves a, b, c of the valve lift plotted against the crankshaft angle KW with respect to three different valve control mechanisms. The points where the lower dead center position UT as well as the upper dead center position OT are reached are respectively indicated by a vertically extending line, at approximately 182° and 361°. The solid thin operating curve "a" as well as the dotted curve "b" each show the lift of the outlet valve of known standard processes. The thicker solid line of the third operating curve "c" shows the valve lift of the outlet valve when the process of the present invention is used for opening and closing the outlet valve.

It is very evident from the graph of FIG. 1 that with a valve lift of the outlet valve pursuant to the operating curves a, b, the outlet valve is opened over a relatively wide range between the lower and upper dead center positions of the piston. In comparison to the opening of the outlet valve pursuant to the present invention, which is represented by the thick solid line of operating curve "c", when practicing the standard processes the outlet valve is not only opened for a longer period of time, but also to a greater or wider extent. In contrast to the known processes, when using the method according to the present invention the outlet opening is again already closed significantly prior to reaching the upper dead center position. As a consequence of the described measures, the residual steam found in the cylinder at this point in time is not discharged or exhausted by the movement of the piston in the direction toward the upper dead center position with the outlet valve closed, but rather is compressed.

A very special embodiment of the inventive method is explained in FIG. 1 by the operating curve "d". With this technical solution, a special configuration of the outlet opening is used. In this case, slots are provided in the cylinder wall that establish a connection or communication between the interior of the cylinder and a steam discharge as soon as the piston edge, in the expansion stroke, passes over the slot. In the exhaust stroke, the at least one slot is again closed as soon as the piston edge has again passed over the slot as a result of the opposite movement of the piston. In the illustrated case, the at least one slot is opened at a crankshaft angle of approximately 20° prior to reaching the lower dead center position, and is again closed at a crankshaft angle of about 20° after the lower dead center position.

Figure 2:
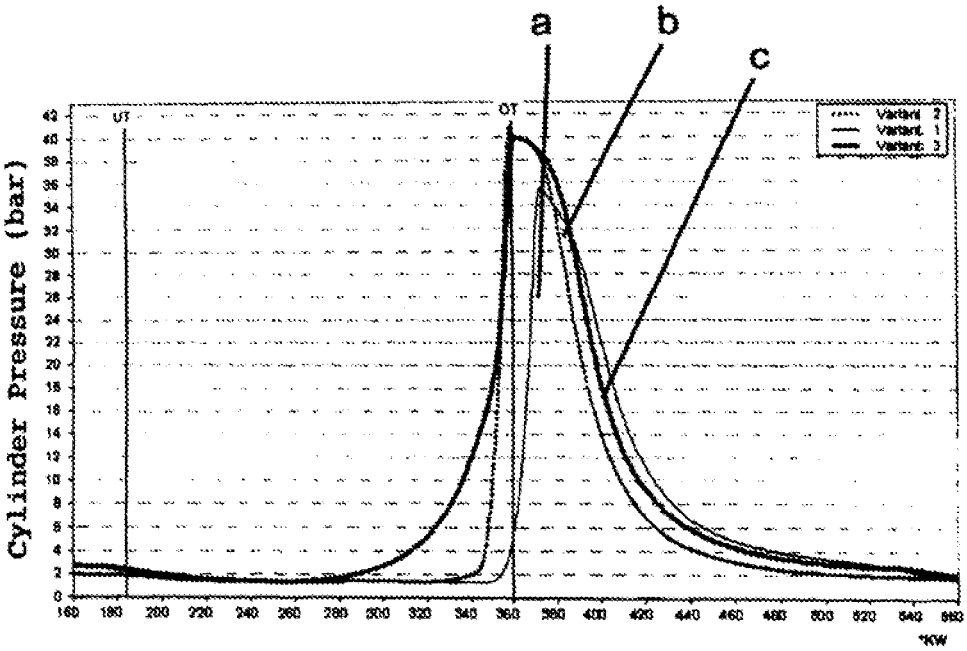
FIG. 2 shows the pressure distribution in the cylinder.

As a supplement to the progress illustrated in FIG. 1 of the lift of the outlet valve during the movement of a piston, the pressure distributions for the three processes illustrated in FIG. 1 for the closing of the outlet opening are illustrated in FIG. 2. It is evident that for the standard processes a, b a very rapid increase in pressure takes place just before the upper dead center position is reached. In comparison thereto, the pressure increase in conjunction with the present method, where an early closing of the outlet valve is effected, in other words significantly before the piston reaches the upper dead center position, is very gentle. This can be attributed to the fact that with an early closing of the outlet valve, the pressure in the cylinder continuously increases due to the compression of the residual steam, whereas where the standard processes a, b are used, the pressure rises only just prior to reaching the upper dead center position, in particular approximately 10° crankshaft angle prior to reaching the upper dead center position.

With respect to the slot control of the outlet opening illustrated in conjunction with the operating curve "d" in FIG. 1, it is noted that the pressure within the cylinder in the exhaust stroke increases as a function of the configuration of the slot, in particular its geometrical shape. In comparison to a valve control, the pressure increase in most cases is effected less gently, with the corresponding pressure distribution curves thus having a somewhat steeper progress in this region. However, it is to be emphasized in this connection, that for the realization of the inventive effect it is immaterial whether the outlet opening is released or closed by means of at least one outlet valve or with the aid of a suitable slot control.

FIG. 3 schematically illustrates the configuration of a steam expander via which the inventive method can be carried out. Since a corresponding steam expander is generally operated in a two-cycle process, crankshaft and camshaft speed are the same, so that the inlet and outlet valves are actuated by means of a corresponding crank web that is provided on the crankshaft. Such a configuration primarily offers the advantage that neither an additional camshaft nor a corresponding drive are required. Of course, it is in principle conceivable to provide an additional camshaft in addition to the crankshaft, even with a steam piston expander operated in a two-cycle process.

As the previous embodiments have shown, the present invention relates to a method for the suitable actuation of inlet and outlet valves of a piston engine for the expansion of steam. For this purpose, three technical possibilities are illustrated in FIG. 3 via which actuation of the valves 4, 5 can be realized. The inventive method, which is chiefly related to the point in time for the opening and closing of the valves 4, 5, can be carried out with each of the possible valve actuation mechanisms.

Figures 3A, 3B, 3C:
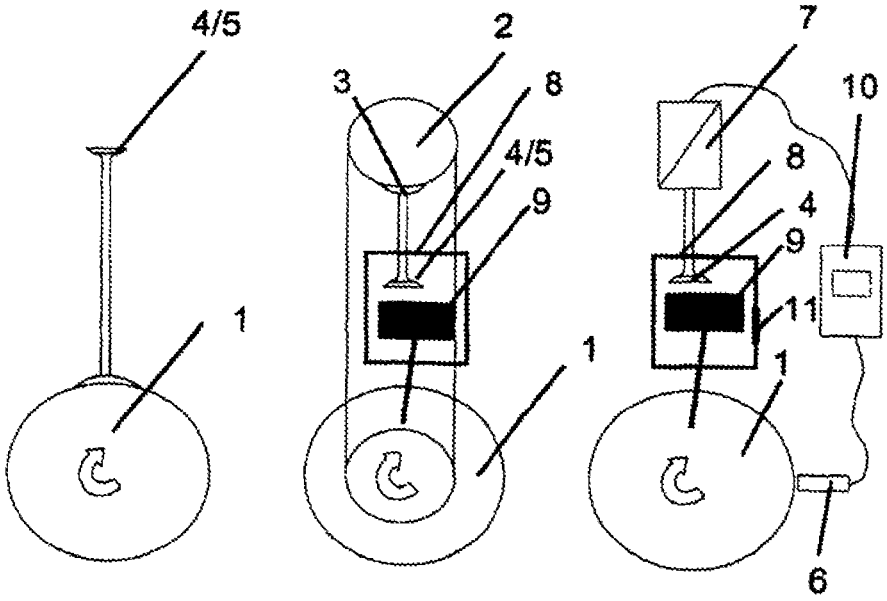
FIG. 3*a*-3*c* are schematic illustrations of a two-cycle steam expander for carrying out the method of the present application.

The components of a steam piston expander that are represented in FIG. 3 and are essential for the realization of the inventive method, include the crankshaft 1, the camshaft 2 with the cam 3 formed thereon, the inlet or intake valve 4, the outlet valve 5, the position sensor 6 and an actuation unit 7. Depending upon which structural configuration is selected for the steam engine, the actuation of the valves is effected via the crankshaft 1 (FIG. 3*a*), via the camshaft 2 (FIG. 3*b*), or via the further actuation unit 7 (FIG. 3*c*), which can be operated electrically, hydraulically or pneumatically. Where a further actuation unit 7 is used, which is primarily characterized in that there is no mechanical connection between the crankshaft 1 and the inlet or outlet valve, further provided are a position sensor 6 on the crankshaft as well as a control unit 10. The position of the crankshaft 1 at any given time is determined with the aid of the position sensor 6 and an appropriate value is conveyed to the control unit as an input variable. This value is processed in the control unit 10, and an output variable is generated on the basis of which the actuation of the inlet or outlet valve 4, 5 is effected by the actuation unit 7.

Common to all three of the valve connections illustrated in FIG. 3 is that fresh or live steam is conveyed to the inlet valve 4 via a steam feed 8. The opening of the inlet valves is effected either by means of a crank web of the crankshaft (FIG. 3*a*), a cam 3 of the camshaft 2 (FIG. 3*b*), or by the actuation unit or device 7 as soon as the piston 9 is in the upper dead center position. When the upper dead center position is reached, compressed residual steam is found within the remaining cylinder volume, the so-called Schad or damage volume; after the expansion, the compressed residual steam is not exhausted, but rather is recompressed. After the inlet valve 4 is opened, live steam flows into the damage volume, whereby as a consequence of the flowing in of live steam, there also takes place a compression of the pre-compressed residual steam disposed in the damage volume of the cylinder. The mixed steam formed in the cylinder ultimately acts via a pressure that corresponds at least approximately to the live steam pressure in the steam feed 8. In this connection, the live steam pressure is achieved by a further compression of the already compressed residual steam within the damage volume of the cylinder, whereby the condition of the steam mixture after introduction of the live steam is established as a function of the conditions of the precompressed residual steam and of the live steam.

At a crankshaft angle of about 30° after the upper dead center position, the inlet valve 4 is again closed. Due to the compressed steam mixture found in the cylinder, the piston 9, in the power stroke, is now moved in the direction of the lower dead center position, so that the steam is expanded. When the lower dead center position is reached, an outlet opening 5 is opened. Pursuant to a first alternative, the outlet opening is embodied as a slot 11 in the cylinder wall; this slot is released as soon as the piston 9 is in the region of the lower dead center position. In a preferred manner, the outlet slot is released by passing-over of the piston edge at a crankshaft angle of about 20° prior to reaching the lower dead center position. As a consequence of the released outlet opening 5 or outlet slot 11, expanded steam mixture now escapes.

As soon as the piston 9 again moves in the direction of the upper dead center position, the outlet opening 5 is closed. To the extent that the outlet opening does not act via an outlet valve, but rather via the already described slot, the latter is again closed due to the movement of the piston in the exhaust stroke and the thereby brought about passing over of the piston edge. Due to the closing of the outlet opening 5 or the outlet slot 11, the residual steam is compressed such that the residual steam pressure is only slightly less than the live steam pressure when the upper dead center position is reached. The low pressure differential between the residual steam and the live steam primarily offers the advantage that upon the introduction of the live steam into the damage volume of the cylinder, steams are intermixed that exergetically are very similar. Furthermore, the components of the cylinder, in particular the inlet valve, are stressed relatively little due to the compression of the residual steam and the low difference between residual steam pressure and live steam pressure connected therewith. In addition, on the basis of the described first possible configuration of the outlet opening 5, there is no need for a valve in addition to the inlet valve 4. After the upper dead center position is achieved, the inlet valve 4 is again opened and the described cyclical process begins anew.

In the second alternative for carrying out the inventive method, a valve is also provided in the outlet opening 5; this valve is actuated via a crank web of the crankshaft 1, a cam 3 of the camshaft 2, or a further actuation unit 7. Pursuant to such a structural configuration of the outlet opening, the outlet valve is opened as soon as the piston has reached the lower dead center position, and is closed at a crankshaft angle of about 45° prior to the upper dead center position. After the outlet valve 5 is closed, the residual steam remaining in the cylinder is again compressed by the movement of the piston, so that in so doing the advantages already mentioned in conjunction with the first alternative are achieved.

Finally, it is noted that due to the preferred operation of a steam piston expansion engine in a two stroke process, the valves are suitably actuated with the aid of a crank web (FIG. 3*a*). This structural configuration has the primary advantage that it is possible to eliminate the use of an additional camshaft.

The specification incorporates by reference the disclosure of Austrian priority document A 160/2010 filed Feb. 5, 2010.

The present invention is, of course, in no way restricted to the specific disclosure of the specification and drawings, but also encompasses any modifications within the scope of the appended claims.

What I claim is:

1. A method of operating a piston expander, including the steps of:

introducing live steam from a steam feed into a cylinder space via an inlet valve;

expanding the live steam, introduced into the cylinder space, during a power stroke in which a piston moves from an upper dead center position into a lower dead center position;

after the piston reaches the lower dead center position, conveying the expanded steam out of an outlet opening and into a steam discharge, whereby compressed residual steam is retained within the cylinder space and is not exhausted;

subsequently closing said outlet opening at least 45° before the piston, in an exhaust stroke when the piston moves from the lower dead center position to the upper dead center position, reaches the upper dead center position, wherein in a time frame between closing of said outlet opening and closing of the inlet valve, a steam mixture is produced by means of the introduction of the live steam into the cylinder space, and wherein the steam mixture has a pressure that corresponds approximately to a pressure of the live steam; and recompressing the residual steam remaining in the cylinder by movement of the piston after the outlet opening is closed, wherein said conveying step comprises opening said outlet opening at a crank angle of from 25° to 15° prior to the lower dead center position, and wherein said closing step comprises closing said outlet opening at a crank angle of from 25° to 15° after the lower dead center position.

2. A method according to claim 1, wherein said conveying step comprises opening said outlet opening at a crank angle of 20° prior to the lower dead center position.

3. A method according to claim 1, wherein said closing step comprises closing said outlet opening at a crank angle of 20° after the lower dead center position.

4. A method according to claim 1, wherein said conveying step comprises opening said outlet opening at least one time between a crankshaft angle of 20° prior to reaching the lower dead center position and a crankshaft angle of 20° after reaching the lower dead center position.

5. A method according to claim 1, wherein in said closing step, said outlet opening is closed in the exhaust stroke in a crankshaft angle range of from 70° to 100° after the lower dead center position.

6. A method according to claim 1, further comprising closing the inlet valve, wherein the inlet valve is closed in a crankshaft position range of 25° to 35° after reaching the upper dead center position.

7. A method according to claim 1, wherein the method is used in a steam circuit, and wherein the live steam is supplied with heat from a coolant circuit of an internal combustion engine.

8. A method according to claim 7, wherein the internal combustion engine is an engine of a motor vehicle.

9. A method of operating a piston expander, including the steps of:

introducing live steam from a steam feed into a cylinder space via an inlet valve;

expanding the live steam, introduced into the cylinder space, during a power stroke in which a piston moves from an upper dead center position into a lower dead center position;

after the piston reaches the lower dead center position, conveying the expanded steam out of an outlet opening and into a steam discharge, whereby compressed residual steam is retained within the cylinder space and is not exhausted;

subsequently closing said outlet opening at least 45° before the piston, in an exhaust stroke when the piston moves from the lower dead center position to the upper dead center position, reaches the upper dead center position, wherein in a time frame between closing of said outlet opening and closing of the inlet valve, a steam mixture is produced by means of the introduction of the live steam into the cylinder space, and wherein the steam mixture has a pressure that corresponds approximately to a pressure of the live steam; and recompressing the residual steam remaining in the cylinder by movement of the piston after the outlet opening is closed, wherein in said closing, said outlet opening is closed in the exhaust stroke in a crankshaft angle range of from 70° to 100° after the lower dead center position.

* * * * *